US009702622B2

(12) United States Patent
Park et al.

(10) Patent No.: US 9,702,622 B2
(45) Date of Patent: Jul. 11, 2017

(54) TURBO CHILLER AND CHILLER SYSTEM INCLUDING THE SAME

(71) Applicant: LG ELECTRONICS INC., Seoul (KR)

(72) Inventors: Hanyoung Park, Seoul (KR); Yoonjei Hwang, Seoul (KR); Horim Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 121 days.

(21) Appl. No.: 14/621,178

(22) Filed: Feb. 12, 2015

(65) Prior Publication Data

US 2015/0338160 A1 Nov. 26, 2015

(30) Foreign Application Priority Data

May 20, 2014 (KR) ..... 10-2014-0060284

(51) Int. Cl.

| | |
|---|---|
| ***F25D 17/02*** | (2006.01) |
| ***F25D 31/00*** | (2006.01) |
| ***F24F 3/06*** | (2006.01) |
| ***F25B 41/00*** | (2006.01) |
| ***F25B 49/02*** | (2006.01) |

(52) U.S. Cl.

CPC ..... *F25D 31/002* (2013.01); *F24F 3/06* (2013.01); *F25B 41/00* (2013.01); *F25B 49/02* (2013.01); *F25D 17/02* (2013.01)

(58) Field of Classification Search

CPC ..... F25D 3/12; F25D 16/00; Y02B 30/62
USPC ..... 62/436, 476, 502, 172, 434, 507
See application file for complete search history.

(56) References Cited

U.S. PATENT DOCUMENTS

| | | | | |
|---|---|---|---|---|
| 5,090,207 | A * | 2/1992 | Gilbertson | F25D 16/00 137/565.34 |
| 6,581,405 | B2 * | 6/2003 | Kim | F25B 15/006 62/434 |
| 2004/0069120 | A1 * | 4/2004 | Muraki | G10H 1/0058 84/609 |
| 2009/0301113 | A1 * | 12/2009 | Ueda | F25B 49/022 62/115 |
| 2013/0312433 | A1 * | 11/2013 | Nemit, Jr. | F24F 1/12 62/56 |

FOREIGN PATENT DOCUMENTS

| | | | |
|---|---|---|---|
| CN | 1383477 | A | 12/2002 |
| CN | 102016443 | A | 4/2011 |
| CN | 102052796 | A | 5/2011 |
| CN | 103403474 | A | 11/2013 |
| KR | 100955607 | B1 | 5/2010 |

* cited by examiner

*Primary Examiner* — Melvin Jones
(74) *Attorney, Agent, or Firm* — Birch, Stewart, Kolasch & Birch, LLP

(57) ABSTRACT

A turbo chiller and a chiller system are disclosed. The turbo chiller includes a compressor including an impeller for compressing a refrigerant and a motor for driving the impeller, a condenser configured to perform heat exchange between condensed water and the refrigerant introduced from the compressor, an evaporator configured to perform heat exchange between chilled water and the refrigerant discharged from the condenser, and an expansion valve disposed between the condenser and the evaporator. The compressor, the evaporator and the condenser are arranged to be stacked in a predetermined direction.

19 Claims, 7 Drawing Sheets

TURBO CHILLER AND CHILLER SYSTEM INCLUDING THE SAME

This application claims the benefit of Korean Patent Application No. 10-2014-0060284, filed on May 20, 2014, which is hereby incorporated by reference as if fully set forth herein.

BACKGROUND OF THE INVENTION

Field of the Invention

The present invention relates to a turbo chiller and a chiller system comprising the same and, more particularly, to a turbo chiller and a chiller system comprising the same capable of coping with various loads through modularization.

Discussion of the Related Art

In general, a turbo chiller is a device that performs heat exchange of chilled water and condensed water using a refrigerant. Such a turbo chiller includes a compressor, an evaporator, a condenser and an expansion valve.

The compressor may include an impeller configured to rotate by driving force of a driving motor, and a variable diffuser configured to convert kinetic energy of fluid discharged by rotation of the impeller into pressure energy.

Condensed water flows into or out of the condenser and is heated while flowing through the condenser. Chilled water flows into or out of the evaporator and is chilled while flowing through the evaporator. The chilled water is supplied to a system demanding chilled water.

The turbo chiller may have various capacities. The capacity of the turbo chiller corresponds to cooling power of a refrigerating system, that is, refrigerating capacity, and may be represented by refrigeration ton (RT). For example, the turbo chiller may have a capacity of 250 RT, 500 RT, 1000 RT, etc.

The turbo chiller may have various sizes according to capacity. In general, as the capacity of the turbo chiller is increased, the volume of the turbo chiller is also increased.

Typically, if the size of the turbo chiller installation space and the capacity of the turbo chiller are decided, the turbo chiller is individually manufactured based on the decided capacity and size of the installation space. However, because the turbo chiller is large-capacity equipment, it takes a relatively long time to manufacture, which causes low productivity and low responsiveness to market demands.

SUMMARY OF THE INVENTION

Accordingly, the present invention is directed to a turbo chiller and a chiller system comprising the same that substantially obviate one or more problems due to limitations and disadvantages of the related art.

An object of the present invention is to provide a turbo chiller and a chiller system comprising the same that can be easily increased in capacity through a modularized structure.

Another object of the present invention is to provide a turbo chiller and a chiller system comprising the same capable of increasing partial load efficiency.

A further object of the present invention is to provide a turbo chiller and a chiller system comprising the same capable of being installed in various manners according to an installation space.

A yet further object of the present invention is to provide a turbo chiller and a chiller system comprising the same capable of enhancing convenience in maintenance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a turbo chiller includes a compressor including an impeller for compressing a refrigerant and a motor for driving the impeller; a condenser configured to perform heat exchange between condensed water and the refrigerant introduced from the compressor; an evaporator configured to perform heat exchange between chilled water and the refrigerant discharged from the condenser; and an expansion valve disposed between the condenser and the evaporator, wherein the compressor, the evaporator and the condenser are arranged to be stacked in a predetermined direction.

The compressor, the evaporator and the condenser may be arranged to be stacked in a direction perpendicular to an installation floor of the turbo chiller.

The evaporator may be positioned between the compressor and the condenser.

The compressor and the evaporator may be arranged such that a rotating center of the impeller and a center of the evaporator are positioned on the substantially same vertical axis.

The condenser and the evaporator may be arranged such that a center of the condenser and a center of the evaporator are positioned on the substantially same vertical axis.

The condenser and the evaporator may be arranged such that a center of the condenser and a center of the evaporator are positioned on different vertical axes.

The evaporator and the condenser may have a cylindrical shape, and the evaporator may have a larger volume than the condenser.

The turbo chiller may further include a control panel for controlling the compressor, and the control panel and the evaporator may be positioned above the condenser.

The turbo chiller may further include a support frame for securing the evaporator and the condenser.

The support frame may include a first plate for securing the evaporator and a second plate for securing the condenser, and a boundary between the first plate and the second plate may be formed to be slanted.

In another aspect of the present invention, a chiller system includes a first turbo chiller including a first compressor, a first evaporator and a first condenser; a second turbo chiller including a second compressor, a second evaporator and a second condenser; a chilled water connection pipe connecting the first evaporator and the second evaporator; and a condensed water connection pipe connecting the first condenser and the second condenser.

The first compressor, the first evaporator and the first condenser are arranged to be stacked in a direction perpendicular to an installation floor of the first turbo chiller. The second compressor, the second evaporator and the second condenser are arranged to be stacked in a direction perpendicular to an installation floor of the second turbo chiller.

The first evaporator may be positioned between the first compressor and the first condenser, and the second evaporator may be positioned between the second compressor and the second condenser.

The first turbo chiller and the second turbo chiller may be arranged in parallel, and the chilled water connection pipe may be formed to be shorter than the condensed water connection pipe.

The first turbo chiller and the second turbo chiller may be arranged in parallel, and a gap between the first evaporator and the second evaporator may be set to be smaller than a gap between the first condenser and the second condenser.

The first turbo chiller may further include a first support frame for securing the first evaporator and the first condenser, the second turbo chiller may further include a second support frame for securing the second evaporator and the second condenser, and the first support frame and the second support frame may have the same height from the installation floor.

The first turbo chiller and the second turbo chiller may be arranged in parallel, and the first support frame and the second support frame may be in contact with each other.

The first turbo chiller and the second turbo chiller may have different refrigerating capacities.

As is apparent from the above description, the turbo chiller and the chiller system comprising the same according to an embodiment of the present invention have the following effects.

The chiller system having a predetermined capacity may be manufactured by assembling the turbo chillers functioning as a base unit.

Herein, the chiller system may be constituted by assembling a plurality of turbo chillers having the same capacity or may be constituted by assembling a plurality of turbo chillers having different capacities. Accordingly, such a modularized chiller system is easily increased in capacity.

Since the turbo chillers functioning as a base unit have a structure capable of being connected to each other in parallel or in series, the chiller system may cope with various installation environments.

Further, the chiller system may be installed in various manners according to an installation space. In addition, since the turbo chiller has a compact design, an installation space may be reduced. Especially, an installation area may be effectively reduced in comparison with a unitary system having the same capacity as the chiller system of the present invention.

Further, partial load efficiency may be increased by driving a part or all of the plurality of turbo chillers.

Further, even when a part of the turbo chillers constituting the chiller system breaks down, continuous operation is possible and convenience in maintenance may be enhanced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
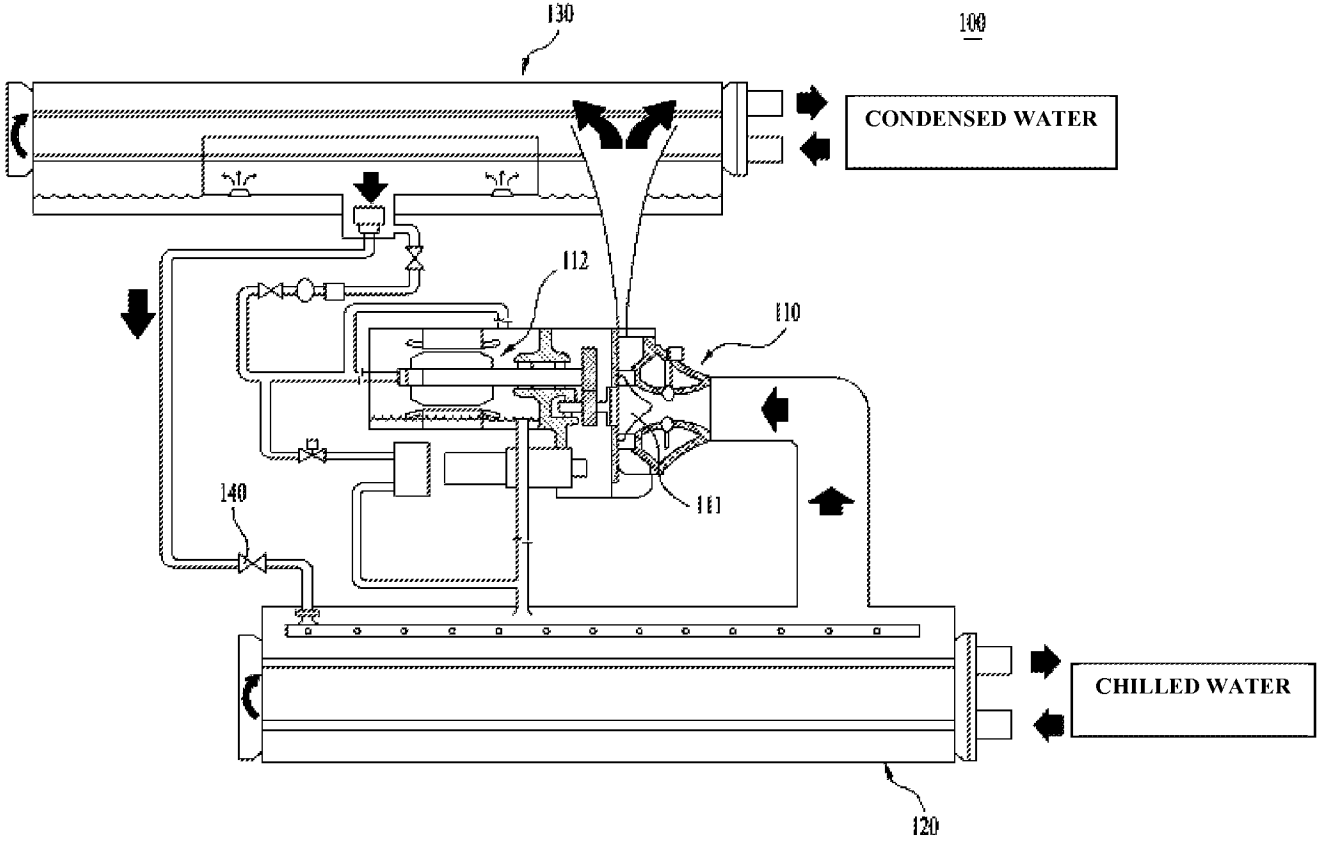
FIG. 1 is a conceptual view illustrating an operating state of a turbo chiller according to an embodiment of the present invention.

Hereinafter, a turbo chiller and a chiller system comprising the same in accordance with embodiments will be described with reference to the accompanying drawings. Reference will now be made in detail to embodiments, examples of which are illustrated in the accompanying drawings.

Further, the same or similar elements are denoted by the same or similar reference numerals even though they are depicted in different drawings, and repetitive a detailed description thereof has thus been omitted. In the drawings, sizes or shapes of elements may be exaggerated or reduced for clarity and convenience of description. Furthermore, it will be understood that, although the terms first, second, etc. may be used herein to describe various elements, these elements should not be limited by these terms.

Hereinafter, a turbo chiller and a chiller system comprising the same in accordance with embodiments will be described in detail with reference to the accompanying drawings.

FIG. 1 is a conceptual view illustrating an operating state of a turbo chiller 100 according to an embodiment of the present invention.

Referring to FIG. 1, a turbo chiller 100 comprises a compressor 110 for compressing a refrigerant, a condenser 130 for condensing a refrigerant, and an evaporator 120 for evaporating a refrigerant.

The compressor 110 includes an impeller 111 for compressing a refrigerant. The compressor 110 further includes a motor 112 for driving the impeller 111. The compressor 110 further includes one or more gears for transmitting driving force from the motor 112 to the impeller 111.

The compressor 110 may include a variable diffuser for adjusting the amount of refrigerant flowing into or out of the impeller 111.

The compressor 110 may further include an oil tank for storing the predetermined amount of oil. The compressor 110 may further include an oil pump for pumping the oil from the oil tank and supplying the oil to internal components (bearings, gears, etc.) of the compressor 110.

The compressor 110 may be implemented as a unitary compression unit or a plurality of compression units.

The evaporator 120 and the condenser 130 may have a shell-in-tube structure. In this case, chilled water and condensed water may respectively flow inside a tube (heat transfer tube), and a refrigerant may be contained in a shell. The shell may have a substantially cylindrical shape. Particularly, the evaporator 120 and the condenser 130 may have a cylindrical shape.

Chilled water flows into or out of the evaporator 120 and exchanges heat with the refrigerant in the evaporator 120, thereby being chilled while passing through the evaporator 120. Then, the chilled water is supplied to a system demanding chilled water.

Condensed water flows into or out of the condenser 130 and exchanges heat with the refrigerant in the condenser 130, thereby being heated while passing through the condenser 130.

An expansion valve 140 may be provided between the condenser 130 and the evaporator 120.

The refrigerant contained in the evaporator 120 and the condenser 130 may be maintained at a predetermined required refrigerant level (for example, flooded type), and such a refrigerant level may be adjusted by the expansion valve 140.

Figure 2:
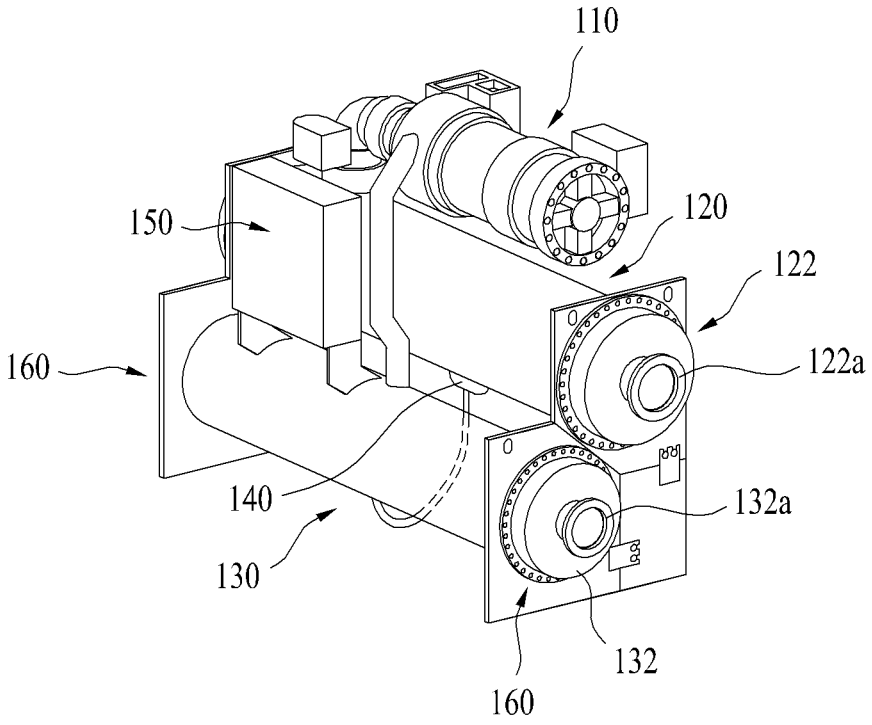
FIG. 2 is a perspective view illustrating main components of a turbo chiller according to an embodiment of the present invention.
Figure 3:
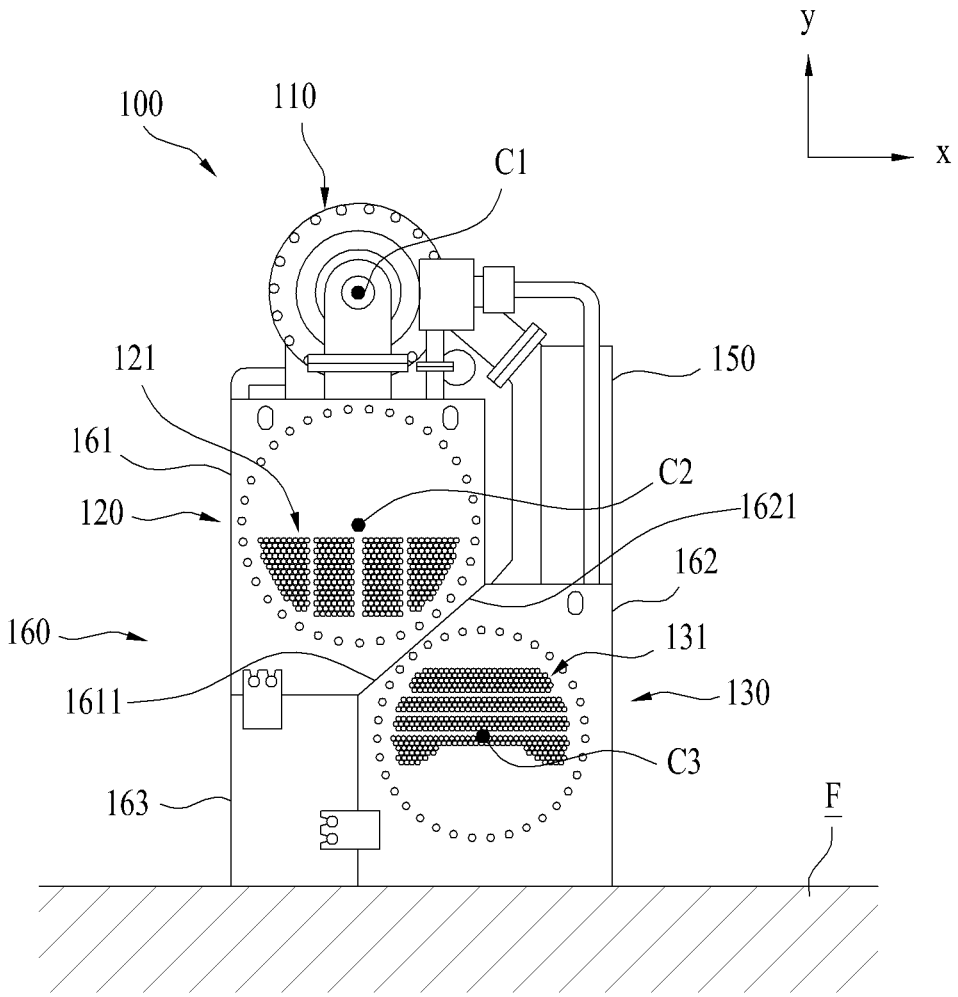
FIG. 3 is a front view of the turbo chiller depicted in FIG. 2.

FIG. 2 is a perspective view illustrating main components of the turbo chiller 100 according to an embodiment of the present invention. FIG. 3 is a front view of the turbo chiller 100 depicted in FIG. 2.

Referring to FIGS. 2 and 3, the turbo chiller 100 comprises the compressor 110, the evaporator 120, the condenser 130 and the expansion valve 140. The turbo chiller 100 functions as a base unit constituting the chiller system, which will be described later. In particular, the turbo chillers may be connected in various ways (for example, in series or in parallel) to constitute the chiller system.

The compressor 110 includes an impeller for compressing a refrigerant and a motor for driving the impeller. Reference numeral C1 refers to a rotating center of the impeller.

As described above, heat exchange between condensed water and the refrigerant introduced from the compressor 110 is carried out in the condenser 130. The condenser 130 may include a cylindrical-shaped shell forming an external appearance of the condenser 130 and a condensed water tube array 131 provided in the shell.

The condensed water flows through the condensed water tube array 131, and exchanges heat with the refrigerant contained in the shell while flowing through the condensed water tube array 131. Reference numeral C3 refers to a center (or central axis) of the condenser 130.

For convenience of explanation, the flowing direction of the condensed water or the chilled water is referred to as a longitudinal direction of the condenser 130 or the evaporator 120, respectively.

The condensed water tube array 131 may be disposed at a region above the center C3 of the condenser 130, considering that a gas-state refrigerant is introduced into the condenser 130.

Heat exchange between chilled water and the refrigerant discharged from the condenser 130 is carried out in the evaporator 120. The evaporator 120 may include a cylindrical-shaped shell forming an external appearance of the evaporator 120 and a chilled water tube array 121 provided in the shell.

The chilled water flows through the chilled water tube array 121, and exchanges heat with the refrigerant contained in the shell while flowing through the chilled water tube array 121. Reference numeral C2 refers to a center (or central axis) of the evaporator 120.

The chilled water tube array 121 may be disposed at a region below the center C2 of the evaporator 120, considering that the refrigerant introduced into the evaporator 120 includes a liquid-state refrigerant.

Herein, the compressor 110, the evaporator 120 and the condenser 130 may be arranged to be stacked in a predetermined direction.

In particular, the compressor 110, the evaporator 120 and the condenser 130 are arranged to be stacked in a direction (y-axis direction) perpendicular to an installation floor F of the turbo chiller 100.

Herein, the evaporator 120 may be positioned between the compressor 110 and the condenser 130. In particular, the turbo chiller 100 has a structure such that the condenser 130, the evaporator 120 and the compressor 110 are stacked in that order from the installation floor F.

This serves to reduce a gap between the compressor 110 and the evaporator 120 so that the gas refrigerant in an upper region of the evaporator 120 can be easily sucked into the compressor 110.

Further, an installation area can be reduced by the structure such that the condenser 130, the evaporator 120 and the compressor 110 are stacked in order.

The compressor 110 and the evaporator 120 may be arranged such that the rotating center C1 of the impeller and the center C2 of the evaporator 120 are positioned on the substantially same vertical axis. In particular, as shown in FIG. 3, the rotating center C1 of the impeller and the center C2 of the evaporator 120 may be positioned on an arbitrary axis which is substantially parallel to the y-axis.

The condenser 130 and the evaporator 120 may be arranged such that the center C3 of the condenser 130 and the center C2 of the evaporator 120 are positioned on the substantially same vertical axis.

Alternatively, as shown in FIG. 3, the condenser 130 and the evaporator 120 may be arranged such that the center C3 of the condenser 130 and the center C2 of the evaporator 120 are positioned on different vertical axes.

Referring to FIG. 3, the center C3 of the condenser 130 may be positioned apart from the center C2 of the evaporator 120 and the rotating center C1 of the compressor 110 by a predetermined gap in the x-axis direction.

As described above, the evaporator 120 and the condenser 130 may have a cylindrical shape, and the evaporator 120 may have a larger volume than the condenser 130. In addition, in this case, in order to reduce a gap between the compressor 110 and the evaporator 120, the evaporator 120 may be positioned between the compressor 110 and the condenser 130.

The turbo chiller 100 may further comprise a control panel 150 for controlling the compressor 110. The control panel 150 may function to receive various control commands and display state information of the turbo chiller 100.

According to one embodiment, a user may control operation of the compressor 110 through the control panel 150. Further, the control panel 150 may display inlet and outlet temperatures of the chilled water flowing through the evaporator 120, inlet and outlet temperatures of the condensed water flowing through the condenser 130, and a temperature of the compressor 110.

The control panel 150 and the evaporator 120 may be positioned above the condenser 130.

Various pipes (for example, refrigerant pipes) constituting the turbo chiller 100 may be extended toward a mounting space of the control panel 150 and connected to each other. This facilitates maintenance in the case in which a plurality of turbo chillers are combined to constitute the chiller system.

The turbo chiller 100 may further comprise a support frame 160 for securing the evaporator 120 and the condenser 130. The support frame 160 may support and secure an end portion of the evaporator 120 and an end portion of the condenser 130.

Alternatively, the turbo chiller 100 may further comprise two or more support frames 160. The support frames 160 may be disposed at both end portions of the evaporator 120 and both end portions of the condenser 130.

The support frame 160 may be implemented as a unitary plate configured to support and secure an end portion of the evaporator 120 and an end portion of the condenser 130 at the same time, or may be implemented as an assembly of a plurality of plates.

The support frame 160 may include a first plate 161 for securing the evaporator 120 and a second plate 162 for securing the condenser 130. In this case, a boundary between the first plate 161 and the second plate 162 may be formed to be slanted.

The support frame 160 may further include a third plate 163 connected to the first plate 161 and the second plate 162. The third plate 163 may function to compensate for the center of gravity of the support frame 160. The plates 161 to 163 may be assembled by welding and/or screw fastening.

Referring to FIGS. 2 and 3, a cap 122 may be provided at an end portion of the evaporator 120. The cap 122 may be formed with a flow hole 122*a* through which chilled water flows. According to an installation condition, the flow hole 122*a* may function as a chilled water inlet or a chilled water outlet.

In addition, a cap 132 may be provided at an end portion of the condenser 130. The cap 132 may be formed with a flow hole 132*a* through which condensed water flows. According to an installation condition, the flow hole 132*a* may function as a condensed water inlet or a condensed water outlet.

The turbo chiller 100 may be constituted such that the flow direction of chilled water flowing through the evaporator 120 is opposite to the flow direction of condensed water flowing through the condenser 130. In other words, referring to FIGS. 2 and 3, in the case in which the flow hole 122*a* of the evaporator 120 is a chilled water outlet, the flow hole 132*a* of the condenser 130 may be a condensed water inlet.

Hereinafter, a chiller system comprising the turbo chiller described above with reference to FIGS. 2 and 3 will be explained.

Figure 4:
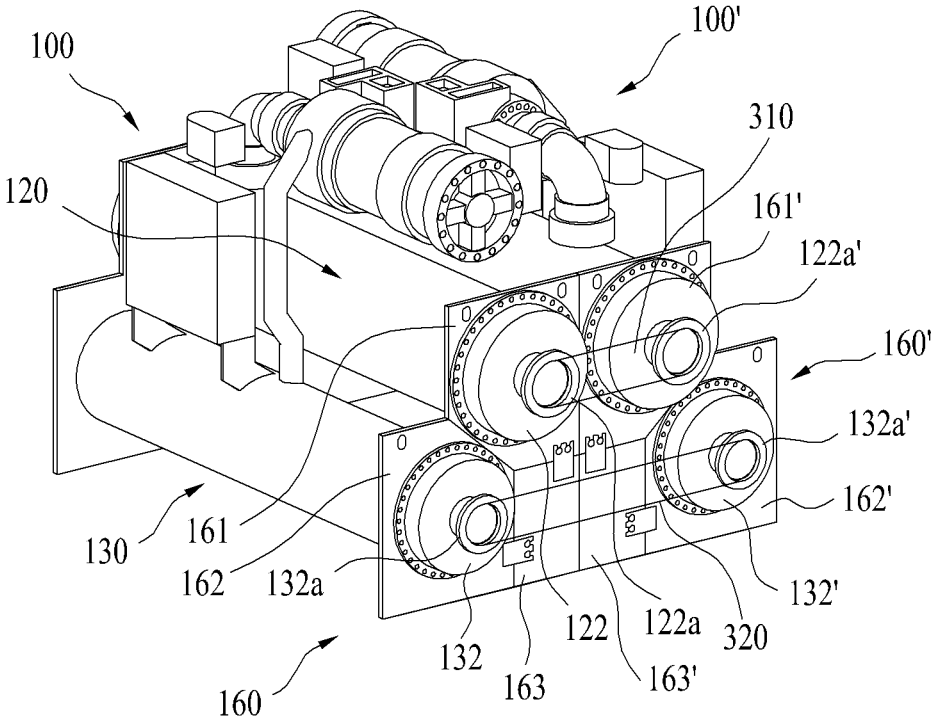
FIG. 4 is a perspective view of a chiller system according to a first embodiment of the present invention.

FIG. 4 is a perspective view of a chiller system according to a first embodiment of the present invention.

Referring to FIG. 4, a chiller system according to a first embodiment of the present invention may be constituted such that a plurality of turbo chillers are arranged side-by-side (i.e. in parallel).

Figure 5:
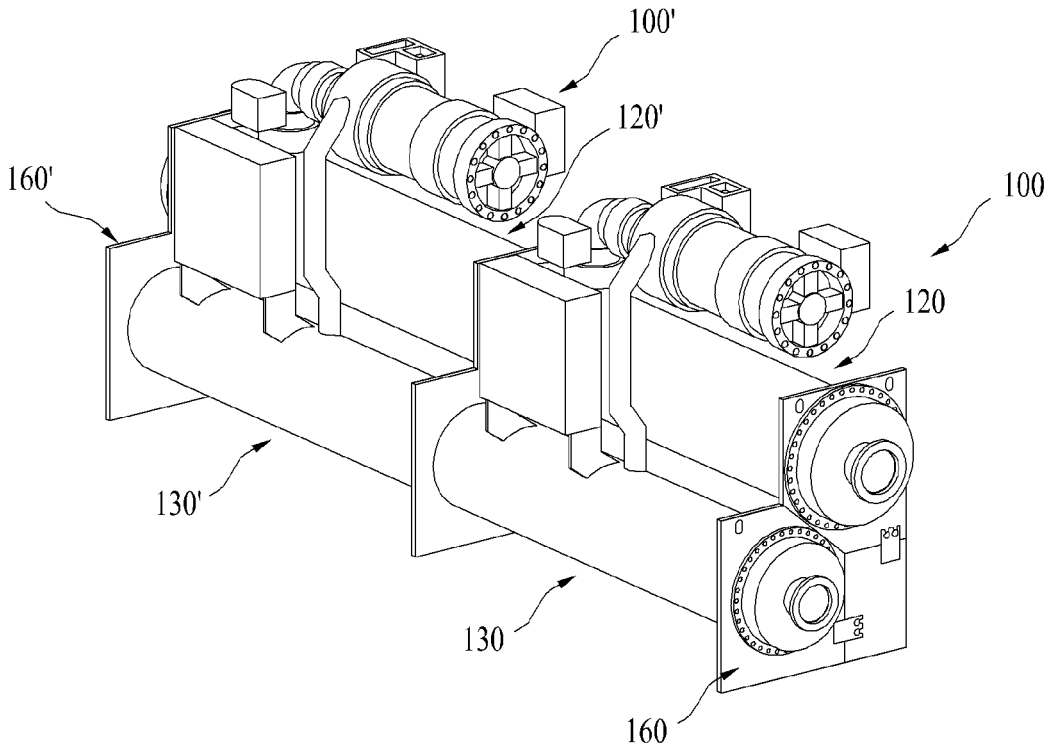
FIG. 5 is a perspective view of a chiller system according to a second embodiment of the present invention.

FIG. 5 is a perspective view of a chiller system according to a second embodiment of the present invention.

Referring to FIG. 5, a chiller system according to a second embodiment of the present invention may be constituted such that a plurality of turbo chillers are arranged end-to-end (i.e. in series).

As shown in FIGS. 4 and 5, the chiller system comprises a plurality of turbo chillers 100 and 100'. For convenience of explanation, the turbo chillers 100 and 100' are referred to as a first turbo chiller 100 and a second turbo chiller 100'.

Herein, the first turbo chiller 100 and the second turbo chiller 100' have the same structure as the turbo chiller 100 described above with reference to FIGS. 2 and 3. The first turbo chiller 100 and the second turbo chiller 100' may have the same capacity and size or different capacities and sizes (see FIG. 7).

The first turbo chiller 100 comprises a first compressor, a first evaporator 120 and a first condenser 130. The second turbo chiller 100' comprises a second compressor, a second evaporator 120' and a second condenser 130'.

The chiller system further comprises a chilled water connection pipe 310 (see FIG. 7) connecting the first evaporator 120 and the second evaporator 120', and a condensed water connection pipe 320 (see FIG. 7) connecting the first condenser 130 and the second condenser 130'.

Herein, the chilled water connection pipe 310 functions as a passage for transmitting the chilled water passing through the chilled water tube array of the first evaporator 120 to the second evaporator 120'. In particular, the chilled water passing through the chilled water tube array of the first evaporator 120 joins at the chilled water connection pipe 310 and then branches to the chilled water tube array of the second evaporator 120'.

The condensed water connection pipe 320 functions as a passage for transmitting the condensed water passing through the condensed water tube array of the first condenser 130 to the second condenser 130'. In particular, the condensed water passing through the condensed water tube array of the first condenser 130 joins at the condensed water connection pipe 320 and then branches to the condensed water tube array of the second condenser 130'.

As described above, the first compressor, the first evaporator and the first condenser are arranged to be stacked in a direction perpendicular to the installation floor of the first turbo chiller 100. The second compressor, the second evaporator and the second condenser are arranged to be stacked in a direction perpendicular to the installation floor of the second turbo chiller 100'.

In particular, the first evaporator 120 is positioned between the first compressor and the first condenser, and the second evaporator 120' is positioned between the second compressor and the second condenser.

Referring to FIG. 4, in the case in which the first turbo chiller 100 and the second turbo chiller 100' are arranged in parallel, the chilled water connection pipe may be formed to be shorter than the condensed water connection pipe.

As described above, caps 122, 122', 132 and 132' are provided at end portions of the evaporators 120 and 120' and end portions of the condensers 130 and 130', and the caps are respectively formed with flow holes 122*a*, 122*a'*, 132*a* and 132*a'*.

The chilled water connection pipe 310 (see FIG. 7) connects the flow holes 122*a* and 122*a'* of two adjacent evaporators 120 and 120'. Similarly, the condensed water connection pipe 320 (see FIG. 7) connects the flow holes 132*a* and 132*a'* of two adjacent condensers 130 and 130'.

Especially, in the case in which the first turbo chiller 100 and the second turbo chiller 100' are arranged in parallel, the chilled water connection pipe 310 and the condensed water connection pipe 320 may be formed as a curved pipe.

In addition, in the case in which the first turbo chiller 100 and the second turbo chiller 100' are arranged in parallel, a gap between the first evaporator 120 and the second evaporator 120' may be set to be smaller than a gap between the first condenser 130 and the second condenser 130'.

Further, in the case in which the first turbo chiller 100 and the second turbo chiller 100' are arranged in parallel, the respective control panels are exposed to the outside so as to facilitate user access.

The first turbo chiller 100 may further comprise a first support frame 160 for securing the first evaporator 120 and the first condenser 130, and the second turbo chiller 100' may further comprise a second support frame 160' for securing the second evaporator 120' and the second condenser 130'.

Herein, referring to FIG. 4, in the case in which the first turbo chiller 100 and the second turbo chiller 100' are arranged in parallel, the first support frame 160 and the second support frame 160' may be in contact with each other. In the case in which each of the support frames includes first to third plates as described above, two adjacent first plates 161 and 161' may be in contact with each other and two adjacent third plates 163 and 163' may be in contact with each other.

Figure 6:
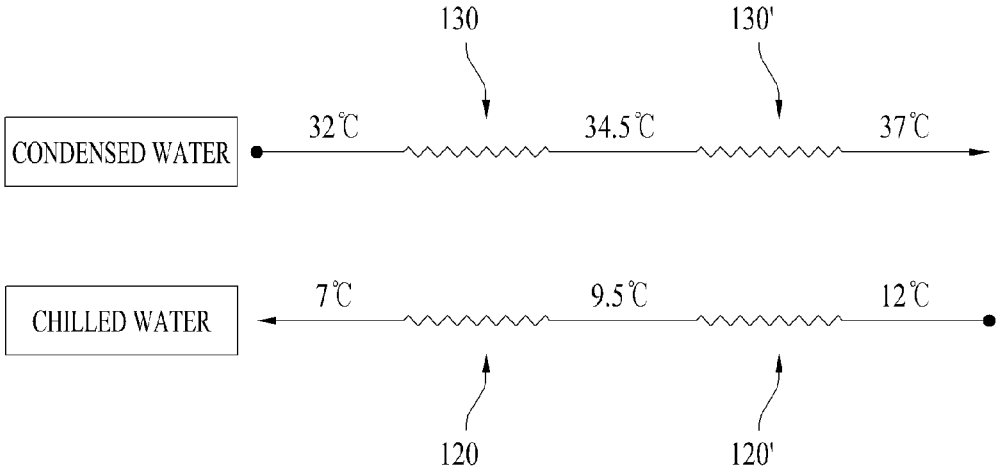
FIG. 6 is a conceptual view for explaining an operating state of the chiller system depicted in FIGS. 4 and 5.

FIG. 6 is a conceptual view for explaining an operating state of the chiller system depicted in FIGS. 4 and 5.

Referring to FIG. 6, in the case in which condensed water passes through the first condenser 130 and the second condenser 130' in order, chilled water passes through the second evaporator 120' and the first evaporator 120 in order. As described above, referring to any one turbo chiller (for example, first turbo chiller 100), the flow direction of chilled water passing through the first evaporator and the flow direction of condensed water passing through the first condenser may be opposite to each other.

Figure 7:
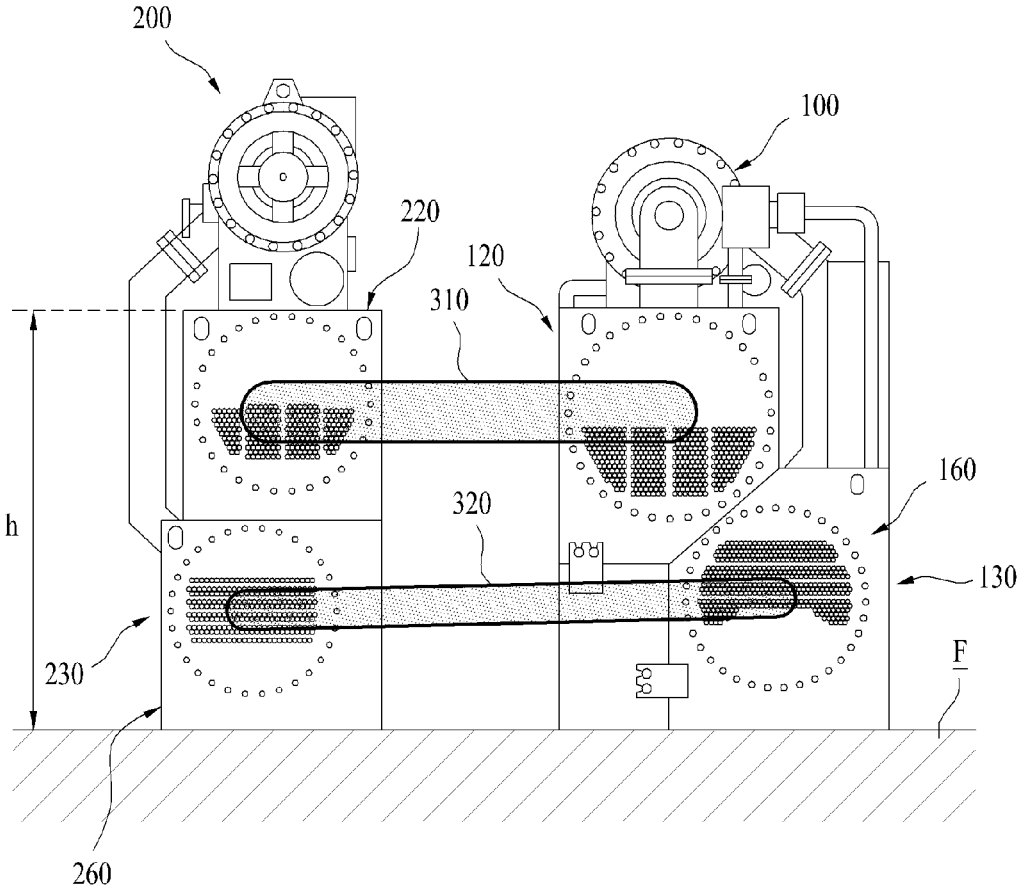
FIG. 7 is a perspective view of a chiller system according to a third embodiment of the present invention.

FIG. 7 is a perspective view of a chiller system according to a third embodiment of the present invention.

The first turbo chiller 100 and the second turbo chiller 200 may have different refrigerating capacities. In particular, the first evaporator 120 and the first condenser 130 of the first turbo chiller 100 may have a respectively different size from the second evaporator 220 and the second condenser 230 of the second turbo chiller 200.

However, in order to facilitate assembly (especially, parallel connection) of the turbo chillers 100 and 200, the first support frame 160 and the second support frame 260 may have the same height h from the installation floor F.

Such a structure can prevent interference between the chilled water connection pipe 310 and the condensed water connection pipe 320.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A turbo chiller comprising:

a compressor including an impeller for compressing a refrigerant and a motor for driving the impeller;

a condenser configured to perform heat exchange between condensed water and the refrigerant introduced from the compressor;

an evaporator configured to perform heat exchange between chilled water and the refrigerant discharged from the condenser; and an expansion valve disposed between the condenser and the evaporator, wherein the compressor, the evaporator and the condenser are stacked in a predetermined direction, wherein the condenser and the evaporator are arranged such that a center of the condenser and a center of the evaporator are positioned on different vertical axes, wherein a bottom of the evaporator and a bottom of the condenser are arranged at different heights, and wherein the evaporator and the condenser have a cylindrical shape, and the evaporator has a larger volume than the condenser.

2. The turbo chiller according to claim 1, wherein the compressor, the evaporator and the condenser are arranged to be stacked in a direction perpendicular to an installation floor of the turbo chiller.

3. The turbo chiller according to claim 1, wherein the evaporator is positioned between the compressor and the condenser.

4. The turbo chiller according to claim 1, wherein a chilled water tube array is provided in the evaporator at a region below a center of the evaporator, and wherein a condensed water tube array is provided in the condenser at a region above a center of the condenser.

5. The turbo chiller according to claim 1, wherein the compressor and the evaporator are arranged such that a rotating center of the impeller and a center of the evaporator are positioned on a substantially same vertical axis.

6. The turbo chiller according to claim 1, wherein the compressor and the evaporator are arranged such that a rotating center of the impeller and a center of the evaporator are positioned on different vertical axes.

7. The turbo chiller according to claim 1, wherein the bottom of the evaporator is lower than a height of a top of the condenser.

8. The turbo chiller according to claim 1, further comprising:

a control panel for controlling the compressor, wherein the control panel and the evaporator are positioned above the condenser.

9. The turbo chiller according to claim 1, further comprising:

a support frame for securing the evaporator and the condenser.

10. The turbo chiller according to claim 9, wherein the support frame comprises:

an evaporator support plate provided at the evaporator, the evaporator support plate including a first slanted surface; and a condenser support plate provided at the condenser, the condenser support plate including a second slanted surface, wherein the first slanted surface of the evaporator support plate abuts against the second slanted surface of the condenser support plate.

11. The turbo chiller according to claim 10, wherein the evaporator is positioned between the compressor and the condenser, wherein a chilled water tube array is provided in the evaporator at a region below a center of the evaporator, wherein a condensed water tube array is provided in the condenser at a region above a center of the condenser, wherein the compressor and the evaporator are arranged such that a rotating center of the impeller and a center of the evaporator are positioned on a substantially same vertical axis, and wherein the bottom of the evaporator is lower than a height of a top of the condenser.

12. A chiller system comprising:

a first turbo chiller including a first compressor, a first evaporator and a first condenser;

a second turbo chiller including a second compressor, a second evaporator and a second condenser;

a chilled water connection pipe connecting the first evaporator and the second evaporator; and a condensed water connection pipe connecting the first condenser and the second condenser, wherein the first compressor, the first evaporator and the first condenser are arranged to be stacked in a direction perpendicular to an installation floor of the first turbo chiller, and wherein the second compressor, the second evaporator and the second condenser are arranged to be stacked in a direction perpendicular to an installation floor of the second turbo chiller.

13. The chiller system according to claim 12, wherein the first evaporator is positioned between the first compressor and the first condenser, and wherein the second evaporator is positioned between the second compressor and the second condenser.

14. The chiller system according to claim 12, wherein the first turbo chiller and the second turbo chiller are arranged side-by-side, and wherein the chilled water connection pipe is shorter than the condensed water connection pipe.

15. The chiller system according to claim 14, wherein chilled water from the first evaporator flows into the second evaporator through the chilled water connection pipe, and wherein condensed water from one of the first condenser and the second condenser flows into an other one of the first condenser and the second condenser through the condensed water connection pipe.

16. The chiller system according to claim 12, wherein the first turbo chiller and the second turbo chiller are arranged side-by-side, and wherein a gap between the first evaporator and the second evaporator is smaller than a gap between the first condenser and the second condenser.

17. The chiller system according to claim 12, wherein the first turbo chiller further includes a first support frame for securing the first evaporator and the first condenser, wherein the second turbo chiller further includes a second support frame for securing the second evaporator and the second condenser, and wherein the first support frame and the second support frame have the same height from the installation floor.

18. The chiller system according to claim 17, wherein the first turbo chiller and the second turbo chiller are arranged side-by-side, and wherein the first support frame and the second support frame are in contact with each other.

19. The chiller system according to claim 12, wherein the first turbo chiller further includes a first support frame for securing the first evaporator and the first condenser, the first support frame comprising:

a first evaporator support plate provided at the first evaporator, the first evaporator support plate including a slanted surface; and a first condenser support plate provided at the first condenser, the first condenser support plate including a slanted surface, wherein the slanted surface of the first evaporator support plate abuts against the slanted surface of the first condenser support plate, wherein the second turbo chiller further includes a second support frame for securing the second evaporator and the second condenser, the second support frame comprising:

a second evaporator support plate provided at the second evaporator, the second evaporator support plate including a slanted surface; and a second condenser support plate provided at the second condenser, the second condenser support plate including a slanted surface, wherein the slanted surface of the second evaporator support plate abuts against the slanted surface of the second condenser support plate, and wherein the first evaporator support plate abuts against the second evaporator support plate.

* * * * *